US011773720B2

(12) United States Patent
Feng et al.

(10) Patent No.: US 11,773,720 B2
(45) Date of Patent: Oct. 3, 2023

(54) MICROWAVE-MECHANICAL FLUIDIZATION MINING SYSTEM AND MINING METHOD FOR METAL MINES

(71) Applicant: NORTHEASTERN UNIVERSITY, Shenyang (CN)

(72) Inventors: Xiating Feng, Shenyang (CN); Feng Lin, Shenyang (CN); Chengxiang Yang, Shenyang (CN); Jiuyu Zhang, Shenyang (CN); Xiangxin Su, Shenyang (CN); Shiping Li, Shenyang (CN)

(73) Assignee: NORTHEASTERN UNIVERSITY, Shenyang (CN)

( * ) Notice: Subject to any disclaimer, the term of this patent is extended or adjusted under 35 U.S.C. 154(b) by 0 days.

(21) Appl. No.: 18/023,481

(22) PCT Filed: Apr. 1, 2021

(86) PCT No.: PCT/CN2021/084818
§ 371 (c)(1),
(2) Date: Feb. 27, 2023

(87) PCT Pub. No.: WO2022/205264
PCT Pub. Date: Oct. 6, 2022

(65) Prior Publication Data

US 2023/0243259 A1 Aug. 3, 2023

(30) Foreign Application Priority Data

Mar. 30, 2021 (CN) ..... 202110338294.9

(51) Int. Cl.
*E21C 37/00* (2006.01)
*E21C 41/22* (2006.01)
(Continued)

(52) U.S. Cl.
CPC ..... *E21C 3/00* (2013.01); *C22B 4/08* (2013.01); *E21C 41/22* (2013.01); *E21F 15/00* (2013.01)

(58) Field of Classification Search
CPC . E21C 37/00; E21C 41/22; C22B 4/08; E21F 15/00
See application file for complete search history.

(56) References Cited

U.S. PATENT DOCUMENTS

| | | | | |
|---|---|---|---|---|
| 6,277,168 | B1 | 8/2001 | Huang et al. | |
| 2004/0107796 | A1 | 6/2004 | Kumar et al. | |
| 2005/0092657 | A1* | 5/2005 | Birken | C22B 1/00 423/139 |
| 2014/0260801 | A1 | 9/2014 | Wellwood et al. | |

FOREIGN PATENT DOCUMENTS

| | | | |
|---|---|---|---|
| CN | 102076432 | A | 5/2011 |
| CN | 102441553 | A | 5/2012 |

(Continued)

OTHER PUBLICATIONS

Lu, Gaoming et al., "Review of theoretical and experimental studies on mechanical rock fragmentation using microwave-assisted approach", Chinese Journal of Geotechnical Engineering, Aug. 2016, pp. 1497-1506, vol. 8, Issue No. 8.

*Primary Examiner* — Janine M Kreck
(74) *Attorney, Agent, or Firm* — Muncy, Geissler, Olds & Lowe, P.C.

(57) ABSTRACT

A microwave-mechanical fluidization mining system and a mining method for metal mines. The microwave-mechanical fluidization mining system comprises a microwave pre-splitting mechanical mining system, a microwave separation system, a high-power microwave focused melting system and a goaf, wherein ore-waste rock mixtures mined by the microwave pre-splitting mechanical mining system are transported to the microwave separation system through a (Continued)

conveyor and an elevator on the microwave pre-splitting mechanical mining system, separated ores are transported to the high-power microwave focused melting system, and separated waste rocks are transported through a conveyor to the goaf for filling. Microwave pre-splitting mechanical mining is adopted instead of a traditional blasting mining method to increase an excavation speed and avoid the influence of blasting on the stability of surrounding rocks.

4 Claims, 5 Drawing Sheets

(51) Int. Cl.

| | |
|---|---|
| ***C22B 4/08*** | (2006.01) |
| ***E21F 15/00*** | (2006.01) |
| ***E21B 1/00*** | (2006.01) |

(56) References Cited

FOREIGN PATENT DOCUMENTS

| | | | |
|---|---|---|---|
| CN | 103397881 | A | 11/2013 |
| CN | 103827445 | A | 5/2014 |
| CN | 104096680 | A | 10/2014 |
| CN | 104368527 | A | 2/2015 |
| CN | 105122045 | A | 12/2015 |
| CN | 111926179 | A | 11/2020 |
| RU | 2091584 | C1 | 9/1997 |
| WO | WO-2013149293 | A1 | 10/2013 |
| WO | WO-2020243919 | A1 | 12/2020 |

* cited by examiner

MICROWAVE-MECHANICAL FLUIDIZATION MINING SYSTEM AND MINING METHOD FOR METAL MINES

BACKGROUND OF THE INVENTION

1. Field of the Invention

The invention relates to the technical field of mining of metal mines, and particularly relates to a microwave-mechanical fluidization mining system and a mining method for metal mines.

2. The Prior Arts

The essence of the mining and dressing of metal mines is ore crushing to extract useful minerals. A traditional metal mine mining process flow lies in that: a drilling and blasting method is used to drill and blast large ores, and then the ores are transported to the ground for ore crushing, ore grinding and flotation. Useful minerals are selected and transported to a smelting plant, and at the same time, it is also necessary to transport aggregates from the ground to fill a goaf.

A traditional mining process from mining to ore dressing is tedious in process flow, long in transportation route and high in cost. In terms of a mining process, the drilling and blasting method is low in construction and advancement speed and has a great impact on the stability of surrounding rocks, which poses a great threat to the construction safety of workers. Especially in the deep mining of metal mines, influence of high ground stress and high temperature will further increase the difficulty and cost of the traditional mining process. Secondly, transportation of filling materials from the ground to the goaf will increase the transportation cost of the filling materials. A traditional ore dressing process is high in energy consumption in ore crushing and ore grinding, especially the effective utilization rate of ore grinding is only 1%, a large amount of steel loss will be generated, while subsequent flotation work will also consume a large quantity of chemical solutions. For low-grade ores, only a small quantity of useful minerals can be extracted at last, and transportation, crushing and flotation of most waste rocks waste huge costs.

SUMMARY OF THE INVENTION

The invention aims to provide a microwave-mechanical fluidization mining system and a mining method for metal mines. A microwave technology is adopted to successively perform mechanical continuous mining on pre-split ores, microwave separation of waste rocks from ores, and microwave focused melting to achieve the purpose of enrichment and melting of metal minerals, and waste rocks are locally transported to a goaf for filling, thereby simplifying an ore mining process and realizing the fluidization mining of metal mines.

In order to achieve the purpose, the invention adopts the following technical solution.

The microwave-mechanical fluidization mining system for metal mines comprises a microwave pre-splitting mechanical mining system, a microwave separation system, a high-power microwave focused melting system and a goaf, wherein ore-waste rock mixtures mined by the microwave pre-splitting mechanical mining system are transported to the microwave separation system through a conveyor I and an elevator on the microwave pre-splitting mechanical mining system, separated ores are transported to the high-power microwave focused melting system, and separated waste rocks are transported through a conveyor V to the goaf for filling.

The microwave pre-splitting mechanical mining system comprises open microwave radiators, a mechanical cutting machine, the conveyor I and the elevator, wherein the conveyor I is fixedly mounted on a ground through a stand on the conveyor I, an output end of the conveyor I is connected with an input end of the elevator, the mechanical cutting machine is fixedly mounted on the ground through a machine body, and is located on one side of the conveyor I, and the open microwave radiators are mounted on a side wall of a machine head of the mechanical cutting machine; and a cutter head of the mechanical cutting machine and the open microwave radiators control a height and an angle through extension and rotation of a mechanical rocker arm on the mechanical cutting machine; the open microwave radiators are divided into horizontally-arranged open microwave radiators and vertically-arranged open microwave radiators, the horizontally-arranged open microwave radiators are arranged at a front end of the mechanical cutting machine in a cutting direction, and the vertically-arranged open microwave radiators are arranged above the mechanical cutting machine in the vertical cutting direction.

The microwave separation system comprises a microwave cavity, a separation controller and a conveyor II, wherein the conveyor II is mounted on the ground through a stand, and an input end of the conveyor II is connected with an output end of the elevator; a microwave generator base is mounted on the stand, close to one side of the elevator, of the conveyor II through a rib plate, a microwave generator I is mounted on an upper surface of the microwave generator base, the microwave generator I is connected with the microwave cavity through a waveguide, and a conveyor belt of the conveyor II penetrates through the microwave cavity; a support plate is mounted on one side, being away from the elevator, of the conveyor II through the rib plate, a support is mounted on the support plate, the separation controller is mounted on an upper surface of the support, a plurality of infrared thermal imagers I and a plurality of air nozzles are mounted on two horizontal beams of the support, and the number of the infrared thermal imagers I is the same as that of the air nozzles; and the air nozzles are arranged directly above a falling position of the ores, the infrared thermal imagers I and the air nozzles are connected with the separation controller, after particles of the ores are heated by the closed microwave cavity under a transmission of the conveyor II, a temperature of the particles is measured by the infrared thermal imagers I, when mixtures of the heated ores and the waste rocks pass through a position directly below a separation control system, the air nozzles are turned on, under an action of air blowing, the ores change a movement path to fall onto a conveyor III, and the waste rocks do not change a movement path to fall onto a conveyor V.

The high-power microwave focused melting system comprises a conveyor III and a vertical ore flow pipeline, wherein the conveyor III is arranged at a lower right of a conveyor II, a conveyor IV is arranged at a lower left of the conveyor III, a conveyor belt of the conveyor IV is a mesh conveyor belt, a conveyor V is arranged at a lower right of the conveyor III, both the conveyor III and the conveyor IV are mounted on the ground through a stand, a molten metal mineral pool mounted on the ground is arranged under the conveyor IV, and an output end of the conveyor III is connected with a crusher through a chute; the crusher is mounted on a stand of the conveyor IV through a support, and the vertical ore flow pipeline is fixedly mounted in the support; an output end of the crusher is connected with an inlet end of the vertical ore flow pipeline, an outer circumference of the vertical ore flow pipeline is successively provided with an upper choke coil, a single-mode heating cavity, a lower choke coil and an electromagnetic coil from top to bottom, wherein an infrared thermal imager II is arranged on one side of the single-mode heating cavity, the single-mode heating cavity is connected with a microwave generator II mounted on the ground through a waveguide, the metal minerals molten by the single-mode heating cavity flow out of an output end of the vertical ore flow pipeline and flow into the molten metal mineral pool through the mesh of a mesh conveyor belt, and separated gangue minerals are conveyed to the goaf through the conveyor IV and the conveyor V.

A mining method using the microwave-mechanical fluidization mining system for the metal mines comprises the following steps:

Step 1: dividing an ore body into several layers according to a one-time cutting height of a mechanical cutting machine, and performing layer-by-layer cutting from bottom to top.

Step 2: simultaneously turning on horizontally-arranged open microwave radiators and vertically-arranged open microwave radiators, performing adjustment to a maximum output power in a safe range, and pre-splitting first and second layers of the ore body respectively, wherein the open microwave radiators and the mechanical cutting machine travel in the same direction, after the horizontally-arranged open microwave radiators pre-split the ore body, the mechanical cutting machine synchronously follows up continuous cutting of the first layer of the ore body, and at the same time, the vertically-arranged open microwave radiators pre-split the second layer of the ore body, and continues to cut the second layer of the ore body after the first layer of the ore body is cut; when the second layer of the ore body is cut, the mechanical cutting machine translates the horizontally-arranged open microwave radiators and a cutter head to the second layer of the ore body through a mechanical rocker arm, at this time, the vertically-arranged open microwave radiators move to a third layer of the ore body, but the second layer of the ore body is pre-split by the vertically-arranged open microwave radiators; according to a cutting effect of the first layer of the ore body, the horizontally-arranged open microwave radiators are selectively turned on or off, and when a cutting speed of the first layer of the ore body meets a site demand, the horizontally-arranged open microwave radiators are turned off; when the cutting speed of the first layer of the ore body cannot meet the site demand, the horizontally-arranged open microwave radiators are turned on; and Step 2 is repeated to continue mining the next layer of the ore body.

Step 3: conveying cut ore body particles to a conveyor II through the conveyor I and the elevator, wherein the ore body particles are heated by a microwave cavity, and a lowest average temperature a of the ore body particles reaching a cut-off grade after microwave treatment is counted by an infrared thermal imager I.

Step 4, taking the lowest average temperature a measured in Step 3 as a standard, wherein when an average temperature of the ore body particles measured by the infrared thermal imager I is less than a, the ore body particles are the waste rocks, the waste rocks slip to the conveyor V at an output end of the conveyor II, and are conveyed to the goaf through the conveyor V; and when the average temperature of the ore body particles measured by the infrared thermal imager I is greater than a, the ore body particles are the ores, a controller opens air nozzles after t seconds according to a feedback of the infrared thermal imager I, at this time, the ores are just directly below the air nozzles, and the ores are blown to a conveyor III through the air nozzles.

Step 5: performing next-stage treatment on the ores with a difference between a melting point of metal minerals and a melting point of gangue minerals exceeding 500° C., determining a best particle size of the ores for microwave heating through a dielectric property test, then outputting separated particles of the ores to a crusher through the conveyor III, and then performing crushing to the best particle size by the crusher.

Step 6: uniformly mixing the particles of the ores having the best particle size after being crushed by the crusher with graphite powder, and delivering the uniformly-mixed particles of the ores to the high-power microwave focused melting system, wherein according to the characteristics that the metal minerals absorb microwaves and have a melting point being smaller than that of the gangue minerals, the metal minerals in the ores are molten to flow out, when an infrared thermal imager II detects that a maximum temperature in a single-mode heating cavity reaches the melting point of the metal minerals, a conveyor IV starts to work, molten metal flows to a molten metal mineral pool through a mesh of a conveyor belt of the conveyor IV, and the separated gangue minerals are conveyed to the goaf through the conveyor V.

Step 7, performing parameter optimization: analyzing a composition of the gangue minerals, wherein a proportion of the graphite powder depends on a melting effect of the gangue minerals, when a content of the metal minerals in the gangue minerals is greater than or equal to 10%, a content of the graphite powder is increased, and a flow speed of the ores is reduced, and when the content of the metal minerals in the gangue minerals is less than 10%, the content of the graphite powder and the flow speed of the ores at this moment are used for working.

The beneficial effects of adopting the technical solution are as follows.

(1) Microwave pre-splitting mechanical mining is adopted instead of a traditional blasting mining method to increase an excavation speed and avoid the influence of blasting on the stability of surrounding rocks.

(2) An ore dressing process is simplified, traditional crushing, ore grinding and flotation process steps are reduced, consumption of non-renewable resources such as steel and chemical solutions is greatly reduced, and the mainly adopted microwave energy can be converted through renewable energy.

(3) Underground microwave separation of ores from waste rocks is performed, microwave enrichment and melting are performed on the ores to generate waste slag gangue minerals, and local materials namely the waste rocks and the gangue minerals are used to fill the goaf, thereby reducing transportation and filling costs.

(4) A method of mixing the ores with graphite powder and combining microwave heating with a conventional heating manner with an electromagnetic coil is adopted to perform microwave enrichment and melting on the ores, so as to accelerate heating and melting of particles of the ores, reduce steel loss of a traditional ore grinding process, expand the application range of microwave melting of the ores, and reduce pollution of chemical solutions in the ore dressing course.

(5) For a microwave-mechanical fluidization mining system and method, clean and renewable microwave energy is mainly used to pretreat the ores in the underground, microwave pre-splitting mechanical mining on the ores, microwave separation of the ores from the waste rocks, microwave enrichment and melting on the ores, and filling the goaf with the waste rocks are successively performed, thereby simplifying the mining and ore dressing process flow, increasing the excavation speed of mines, and reducing the mechanical mining cost.

Figure 1:
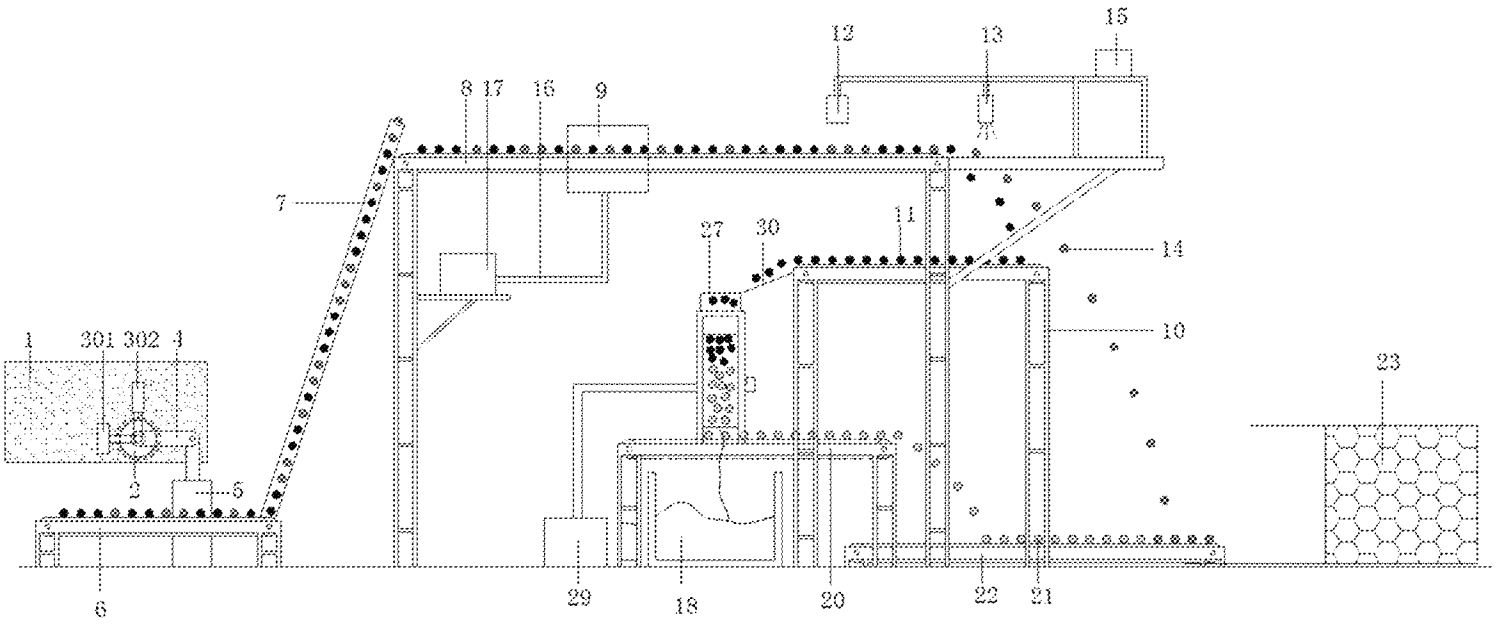
FIG. 1 is a schematic diagram of a microwave-mechanical fluidization mining system for metal mines of the invention.

In the drawings, 1: ore body; 2: cutter head; 301: horizontally-arranged open microwave radiator; 302: vertically-arranged open microwave radiator; 4: mechanical rocker arm; 5: machine body; 6: conveyor I; 7: elevator; 8: conveyor II; 9: microwave cavity; 10: conveyor III; 11: ore; 12: infrared thermal imager I; 13: air nozzle; 14: waste rock; 15: separation controller; 16: waveguide; 17: microwave generator I; 18: molten metal mineral pool; 19: single-mode heating cavity; 20: conveyor IV; 21: gangue mineral; 22: conveyor V; 23: goaf; 24: electromagnetic coil; 25: choke coil; 26: graphite powder; 27: crusher; 28: infrared thermal imager II; 29: microwave generator II; and 30: chute.

DETAILED DESCRIPTION OF THE PREFERRED EMBODIMENT

The present invention will be further described in detail with the accompanying drawings and embodiments.

Figure 2:
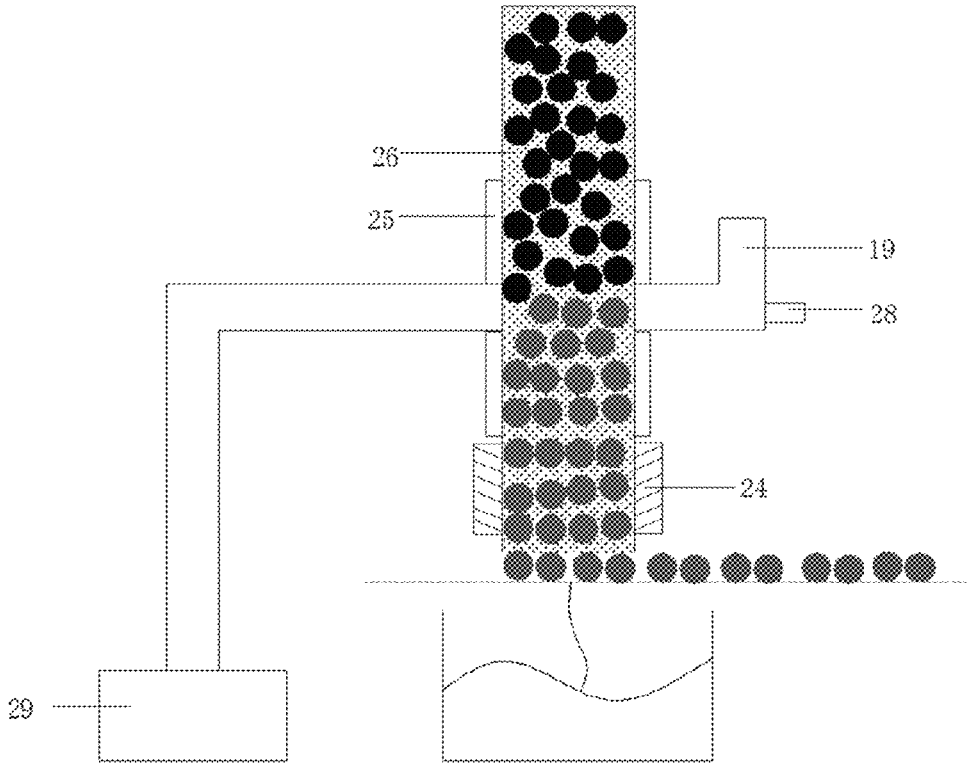
FIG. 2 is a schematic diagram of a high-power microwave focused melting system of the microwave-mechanical fluidization mining system for metal mines of the invention.
Figure 3:
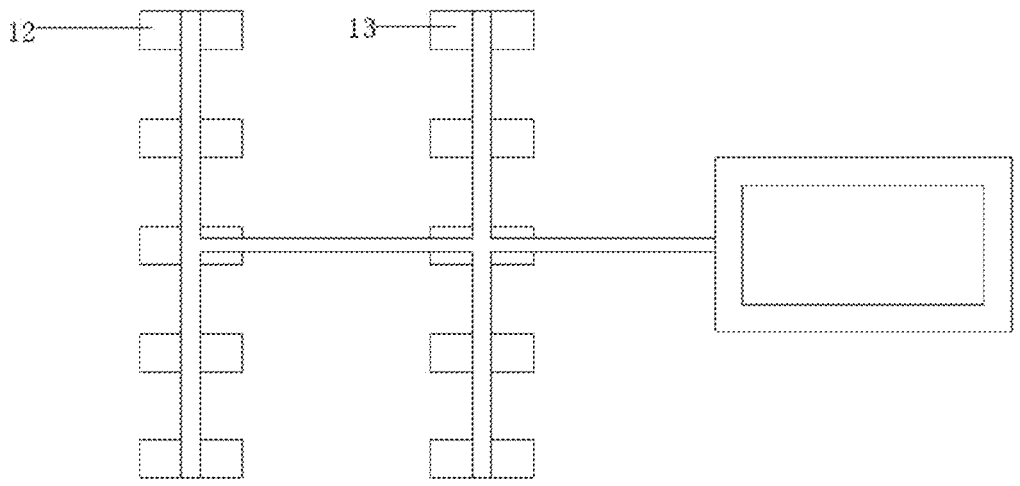
FIG. 3 is a top view of the structure of infrared thermal imagers I and air nozzles of the microwave-mechanical fluidization mining system for metal mines of the invention.
Figure 4:
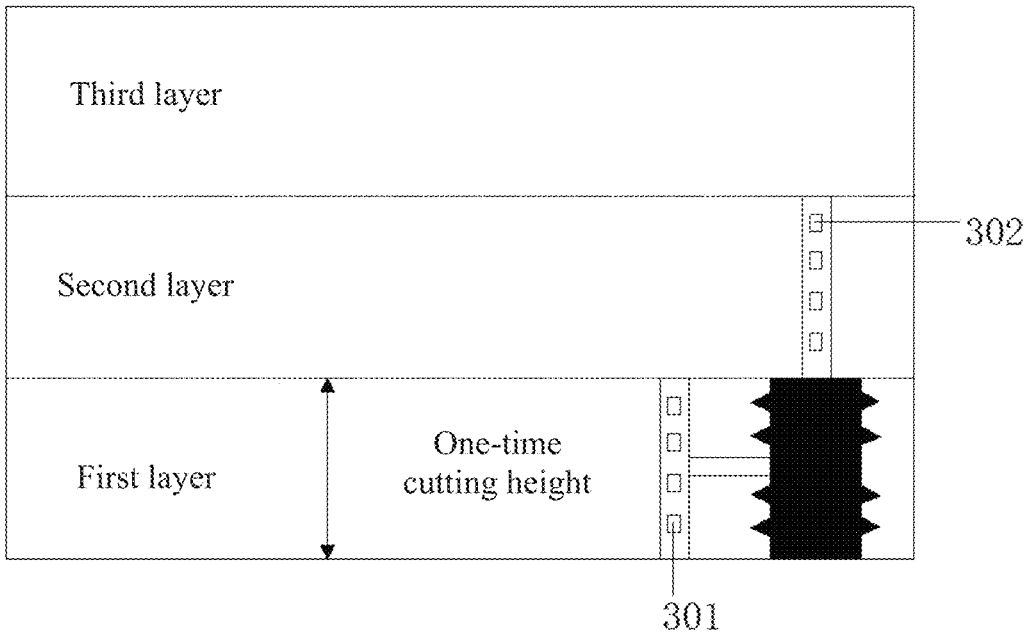
FIG. 4 is a schematic diagram of layering of an ore body of the microwave-mechanical fluidization mining system for metal mines of the invention.
Figure 5:
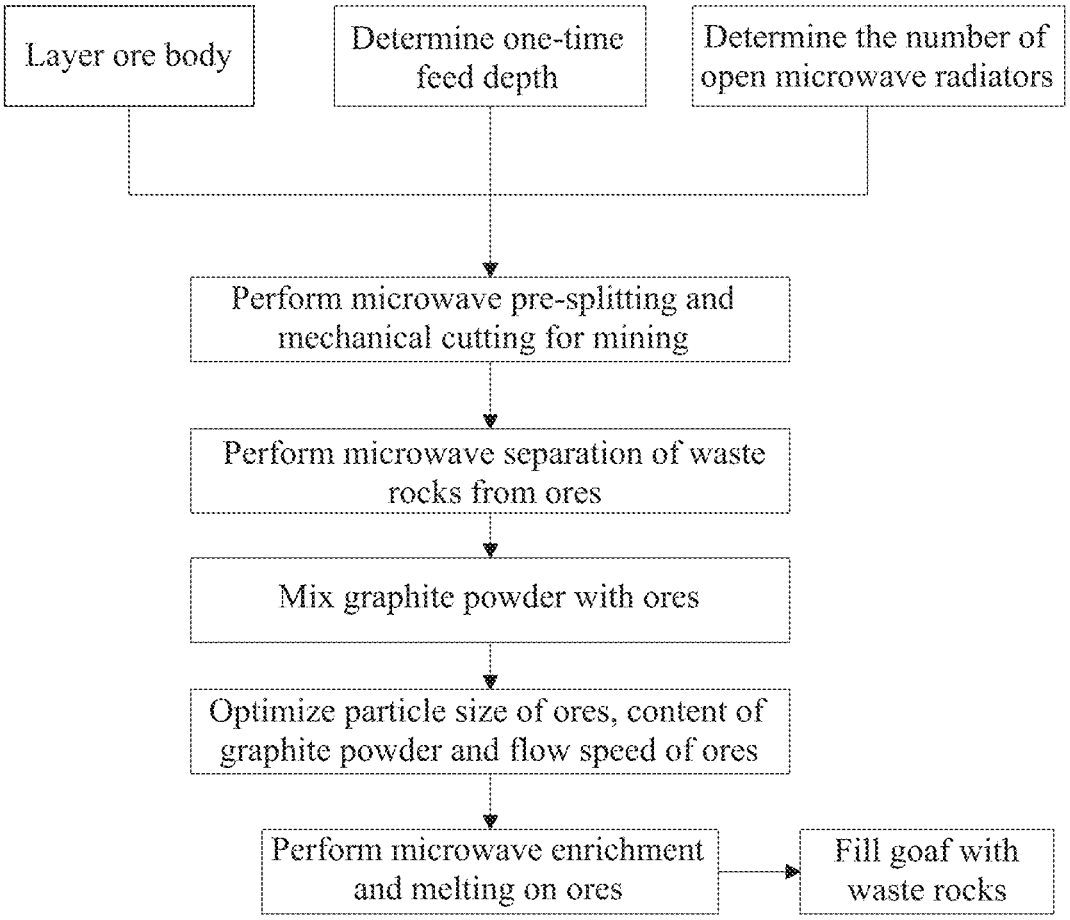
FIG. 5 is a mining flow diagram of the microwave-mechanical fluidization mining system for metal mines of the invention.

As shown in FIGS. 1-5, a microwave-mechanical fluidization mining system for metal mines comprises a microwave pre-splitting mechanical mining system, a microwave separation system, a high-power microwave focused melting system and a goaf 23, wherein ore-waste rock mixtures mined by the microwave pre-splitting mechanical mining system are transported to the microwave separation system through a conveyor I 6 and an elevator 7, separated ores 11 are transported to the high-power microwave focused melting system, and separated waste rocks 14 are transported through a conveyor V 22 to the goaf 23 for filling.

The microwave pre-splitting mechanical mining system comprises open microwave radiators, a mechanical cutting machine, the conveyor I 6 and the elevator 7, wherein the conveyor I 6 is fixedly mounted on a ground through a stand on the conveyor I 6, an output end of the conveyor I 6 is connected with an input end of the elevator 7, the mechanical cutting machine is fixedly mounted on the ground through a machine body 5, and is located on one side of the conveyor I 6, and a primary feed depth of the mechanical cutting machine is 5-8 times of a penetration depth of the ores 11; the horizontally-arranged open microwave radiators 301 and the vertically-arranged open microwave radiators 302 are mounted on the side wall of the machine head of the mechanical cutting machine; the cutter head 2 of the mechanical cutting machine and the open microwave radiators control a height and an angle through the extension and rotation of the mechanical rocker arm 4 on the mechanical cutting machine; the horizontally-arranged open microwave radiators 301 are arranged at the front end of the mechanical cutting machine in the cutting direction, and the vertically-arranged open microwave radiators 302 are arranged above the mechanical cutting machine in the vertical cutting direction; the frequency of the open microwave radiators is 915 MHz; the type of the open microwave radiators depends on the type of the ores 11; for the ores 11 having good homogeneity, flat mouth open microwave radiators are used, and for the ores 11 having poor homogeneity, large horn open microwave radiators are used; and the number of the open microwave radiators is equal to the ratio of the height of two layers to the pre-splitting range of the single open microwave radiator.

The microwave separation system comprises a microwave cavity 9, a separation controller 15 and a conveyor II 8, wherein the microwave frequency of the microwave generator I 17 is 2.45 GHz; the conveyor II 8 is mounted on the ground through a stand, and an input end of the conveyor II 8 is connected with an output end of the elevator 7; a microwave generator base is mounted on the stand, close to one side of the elevator 7, of the conveyor II 8 through a rib plate, a microwave generator I 17 is mounted on an upper surface of the microwave generator base, the microwave generator I 17 is connected with the microwave cavity 9 through a waveguide 16, and a conveyor belt of the conveyor II 8 penetrates through the microwave cavity 9; a support plate is mounted on one side, being away from the elevator 7, of the conveyor II 8 through the rib plate, a support is mounted on the support plate, the separation controller 15 is mounted on an upper surface of the support, a plurality of infrared thermal imagers I 12 and a plurality of air nozzles 13 are mounted on two horizontal beams of the support, and the number of the infrared thermal imagers I 12 is the same as that of the air nozzles 13; and the air nozzles 13 are arranged directly above a falling position of the ores 11, the infrared thermal imagers I 12 and the air nozzles 13 are connected with the separation controller 15, after the particles of the ores 11 are heated by the closed microwave cavity 9 under the transmission of the conveyor II 8, the temperature of the particles is measured by the infrared thermal imagers I 12, when the mixtures of the heated ores 11 and the waste rocks 14 pass through a position directly below a separation control system, the air nozzles 13 are turned on, under the action of air blowing, the ores 11 change a movement path to fall onto a conveyor III 10, and the waste rocks 14 do not change a movement path to fall onto a conveyor V 22.

The high-power microwave focused melting system comprises the conveyor III 10 and a vertical ore flow pipeline, wherein the conveyor III 10 is arranged at the lower right of a conveyor II 8, a conveyor IV 20 is arranged at the lower left of the conveyor III 10, a conveyor belt of the conveyor IV 20 is a mesh conveyor belt, the conveyor belt of the conveyor IV 20 is the mesh conveyor belt, the diameter of the mesh of the conveyor belt of the conveyor IV 20 is smaller than the particle size of the graphite powder 26, a conveyor V 22 is arranged at the lower right of the conveyor III 10, both the conveyor III 10 and the conveyor IV 20 are mounted on the ground through a stand, a molten metal mineral pool 18 mounted on the ground is arranged under the conveyor IV 20, and the output end of the conveyor III 10 is connected with a crusher 27 through a chute 30; and the crusher 27 is mounted on the stand of the conveyor IV 20 through a support, and a vertical ore flow pipeline is fixedly mounted in the support; the output end of the crusher 27 is connected with the inlet end of the vertical ore flow pipeline, an outer circumference of the vertical ore flow pipeline is successively provided with an upper choke coil 25, a single-mode heating cavity 19, a lower choke coil 25 and an electromagnetic coil 24 from top to bottom, wherein an infrared thermal imager II 28 is arranged on one side of the single-mode heating cavity 19, the single-mode heating cavity 19 is connected with a microwave generator II 29 mounted on the ground through a waveguide, metal minerals molten by the single-mode heating cavity 19 flow out of the output end of the vertical ore flow pipeline and flow into the molten metal mineral pool 18 through the mesh of the mesh conveyor belt, and the separated gangue minerals 21 are conveyed to the goaf 23 through the conveyor IV 20 and the conveyor V 22.

The vertical ore flow pipeline, the upper choke coil 25, the single-mode heating cavity 19 and the lower choke coil 25 form a microwave heating system, wherein the single-mode heating cavity 19 adopts a single-mode cavity structure with the microwave frequency of 915 MHz, and the vertical ore flow pipeline of the microwave heating system coaxially sleeves a high-temperature resistant quartz tube with a diameter of 20 cm and a melting point of 1800° C.; and the bottom of the vertical ore flow pipeline and the electromagnetic coil 24 form a conventional heating system, wherein the electromagnetic coil 24 causes the high temperature at the bottom of the vertical ore flow pipeline so as to prevent the metal minerals cooled by the choke coil 25 from condensing into blocks.

The mining method using the microwave-mechanical fluidization mining system for metal mines comprises the following steps.

Step 1: dividing an ore body into several layers according to a one-time cutting height of a mechanical cutting machine, and performing layer-by-layer cutting from bottom to top, wherein the layer-by-layer height is equal to the one-time cutting height of the mechanical cutting machine.

Step 2: simultaneously turning on horizontally-arranged open microwave radiators 301 and vertically-arranged open microwave radiators 302, performing adjustment to a maximum output power in a safe range, and pre-splitting first and second layers of the ore body 1 respectively, wherein the open microwave radiators and the mechanical cutting machine travel in the same direction, after the horizontally-arranged open microwave radiators 301 pre-split the ore body 1, the mechanical cutting machine synchronously follows up continuous cutting of the first layer of the ore body, and at the same time, the vertically-arranged open microwave radiators 302 pre-split the second layer of the ore body, and continues to cut the second layer of the ore body after the first layer of the ore body is cut; when the second layer of the ore body is cut, the mechanical cutting machine translates the horizontally-arranged open microwave radiators 301 and a cutter head 2 to the second layer of the ore body through a mechanical rocker arm 4, at this time, the vertically-arranged open microwave radiators 302 move to a third layer of the ore body, and the second layer of the ore body is pre-split by the vertically-arranged open microwave radiators 302; according to a cutting effect of the first layer of the ore body, the horizontally-arranged open microwave radiators are selectively turned on or off, and when a cutting speed of the first layer of the ore body meets a site demand, the horizontally-arranged open microwave radiators are turned off; when the cutting speed of the first layer of the ore body cannot meet the site demand, the horizontally-arranged open microwave radiators are turned on; and Step 2 is repeated to continue mining the next layer of the ore body, and Step 2 is repeated to continue mining along a longitudinal direction after completion of full section mining at one time.

Step 3: conveying cut ore body particles to a conveyor II 8 through the conveyor I 6 and the elevator 7, wherein the ore body particles are heated by a microwave cavity 9, and the lowest average temperature a of the ore body particles reaching a cut-off grade after microwave treatment is counted by an infrared thermal imager I 12.

Step 4, taking the lowest average temperature a measured in Step 3 as a standard, wherein when an average temperature of the ore body particles measured by the infrared thermal imager I 12 is less than a, the ore body particles are the waste rocks 14, the waste rocks 14 slip to the conveyor V 22 at the output end of the conveyor II 8, and are conveyed to the goaf 23 through the conveyor V 22; and when the average temperature of the ore body particles measured by the infrared thermal imager I 12 is greater than a, the ore body particles are the ores 11, a controller opens air nozzles 13 after t seconds according to a feedback of the infrared thermal imager I 12, at this time, the ores 11 are just directly below the air nozzles 13, and the ores 11 are blown to a conveyor III 10 through the air nozzles 13.

Step 5: performing a next-stage treatment on the ores with the difference between the melting point of metal minerals and the melting point of gangue minerals 21 exceeding 500° C., determining the best particle size of the ores 11 for the microwave heating through a dielectric property test, then outputting the separated particles of the ores 11 to a crusher 27 through the conveyor III 10, and then performing crushing to the best particle size by a crusher 27.

Step 6: uniformly mixing the particles of the ores 11 having the best particle size after being crushed by the crusher 27 with graphite powder 26, wherein the melting point of the graphite powder 26 is 3800° C., the graphite powder 26 has the characteristic of quick temperature increment under the microwave condition, and has the effects that the graphite powder 26 is attached to the surfaces of the granules of the ores 11 to accelerate the temperature increment of the granules of the ores 11; delivering uniformly-mixed particles of the ores 11 to the high-power microwave focused melting system, wherein according to the characteristics that the metal minerals absorb microwaves and have the melting point being smaller than that of the gangue minerals 21, the metal minerals in the ores 11 are molten to flow out, when the infrared thermal imager II 28 detects that the maximum temperature in a single-mode heating cavity 19 reaches the melting point of the metal minerals, the conveyor IV 20 starts to work, molten metal flows to a molten metal mineral pool 18 through a mesh of a conveyor belt of the conveyor IV 20, and the separated gangue minerals 21 are conveyed to the goaf 23 through the conveyor V 22.

Step 7, performing parameter optimization: analyzing a composition of the gangue minerals 21, wherein a proportion of the graphite powder 26 depends on a melting effect of the gangue minerals 21, when a content of the metal minerals in the gangue minerals 21 is greater than or equal to 10%, a content of the graphite powder 26 is increased, and a flow speed of the ores 11 is reduced, and when the content of the metal minerals in the gangue minerals 21 is less than 10%, the content of the graphite powder 26 and the flow speed of the ores 11 at this moment are used for working.

What is claimed is:

1. A microwave-mechanical fluidization mining system for metal mines, comprising a microwave pre-splitting mechanical mining system, a microwave separation system, a high-power microwave focused melting system and a goaf, wherein ore-waste rock mixtures mined by the microwave pre-splitting mechanical mining system are transported to the microwave separation system through a conveyor I and an elevator on the microwave pre-splitting mechanical mining system, separated ores are transported to the high-power microwave focused melting system, and separated waste rocks are transported through a conveyor V to the goaf for filling, wherein the high-power microwave focused melting system comprises a conveyor III and a vertical ore flow pipeline, wherein the conveyor III is arranged at a lower right of a conveyor II, a conveyor IV is arranged at a lower left of the conveyor III, a conveyor belt of the conveyor IV is a mesh conveyor belt, the conveyor V is arranged at a lower right of the conveyor III, both the conveyor III and the conveyor IV are mounted on a ground through a stand, a molten metal mineral pool mounted on the ground is arranged under the conveyor IV, and an output end of the conveyor III is connected with a crusher through a chute; the crusher is mounted on a stand of the conveyor IV through a support, and the vertical ore flow pipeline is fixedly mounted in the support; an output end of the crusher is connected with an inlet end of the vertical ore flow pipeline, an outer circumference of the vertical ore flow pipeline is successively provided with an upper choke coil, a single-mode heating cavity, a lower choke coil and an electromagnetic coil from top to bottom, wherein an infrared thermal imager II is arranged on one side of the single-mode heating cavity, the single-mode heating cavity is connected with a microwave generator II mounted on the ground through a waveguide, metal minerals melted by the single-mode heating cavity flow out of an output end of the vertical ore flow pipeline and flow into the molten metal mineral pool through a mesh of the mesh conveyor belt, and separated gangue minerals are conveyed to the goaf through the conveyor IV and the conveyor V.

2. The microwave-mechanical fluidization mining system according to claim 1, wherein the microwave pre-splitting mechanical mining system comprises open microwave radiators, a mechanical cutting machine, the conveyor I and the elevator, wherein the conveyor I is fixedly mounted on the ground through a stand on the conveyor I, an output end of the conveyor I is connected with an input end of the elevator, the mechanical cutting machine is fixedly mounted on the ground through a machine body, and is located on one side of the conveyor I, and the open microwave radiators are mounted on a side wall of a machine head of the mechanical cutting machine; and a cutter head of the mechanical cutting machine and the open microwave radiators control a height and an angle through extension and rotation of a mechanical rocker arm on the mechanical cutting machine; the open microwave radiators are divided into horizontally-arranged open microwave radiators and vertically-arranged open microwave radiators, the horizontally-arranged open microwave radiators are arranged at a front end of the mechanical cutting machine in a cutting direction, and the vertically-arranged open microwave radiators are arranged above the mechanical cutting machine in a vertical cutting direction.

3. The microwave-mechanical fluidization mining system according to claim 1, wherein the microwave separation system comprises a microwave cavity, a separation controller and the conveyor II, wherein the conveyor II is mounted on the ground through a stand, and an input end of the conveyor II is connected with an output end of the elevator; a microwave generator base is mounted on the stand, close to one side of the elevator, of the conveyor II through a rib plate, a microwave generator I is mounted on an upper surface of the microwave generator base, the microwave generator I is connected with the microwave cavity through a waveguide, and a conveyor belt of the conveyor II penetrates through the microwave cavity; a support plate is mounted on one side, being away from the elevator, of the conveyor II through the rib plate, a support is mounted on the support plate, the separation controller is mounted on an upper surface of the support, a plurality of infrared thermal imagers I and a plurality of air nozzles are mounted on two horizontal beams of the support, and the number of the infrared thermal imagers I is the same as that of the air nozzles; and the air nozzles are arranged directly above a falling position of the ores, the infrared thermal imagers I and the air nozzles are connected with the separation controller, after particles of the ores are heated by the closed microwave cavity under a transmission of the conveyor II, a temperature of the particles is measured by the infrared thermal imagers I, when mixtures of the heated ores and the waste rocks pass through a position directly below a separation control system, the air nozzles are turned on, under an action of air blowing, the ores change a movement path to fall onto the conveyor III, and the waste rocks do not change a movement path to fall onto the conveyor V.

4. A mining method using the microwave-mechanical fluidization mining system according to claim 1, comprising the following steps:

Step 1: dividing an ore body into several layers according to a one-time cutting height of a mechanical cutting machine, and performing layer-by-layer cutting from bottom to top;

Step 2: simultaneously turning on horizontally-arranged open microwave radiators and vertically-arranged open microwave radiators, performing adjustment to a maximum output power in a safe range, and pre-splitting first and second layers of the ore body respectively, wherein the open microwave radiators and the mechanical cutting machine travel in the same direction, after the horizontally-arranged open microwave radiators pre-split the ore body, the mechanical cutting machine synchronously follows up continuous cutting of the first layer of the ore body, and at the same time, the vertically-arranged open microwave radiators pre-split the second layer of the ore body, and continues to cut the second layer of the ore body after the first layer of the ore body is cut; when the second layer of the ore body is cut, the mechanical cutting machine translates the horizontally-arranged open microwave radiators and a cutter head to the second layer of the ore body through a mechanical rocker arm, at this time, the vertically-arranged open microwave radiators move to a third layer of the ore body, and the second layer of the ore body is pre-split by the vertically-arranged open microwave radiators; according to a cutting effect of the first layer of the ore body, the horizontally-arranged open microwave radiators are selectively turned on or off, and when a cutting speed of the first layer of the ore body meets a site demand, the horizontally-arranged open microwave radiators are turned off; when the cutting speed of the first layer of the ore body cannot meet the site demand, the horizontally-arranged open microwave radiators are turned on; and Step 2 is repeated to continue mining the next layer of the ore body;

Step 3: conveying cut ore body particles to the conveyor II through the conveyor I and the elevator, wherein the ore body particles are heated by a microwave cavity, and a lowest average temperature a of the ore body particles reaching a cut-off grade after microwave treatment is counted by an infrared thermal imager I;

Step 4, taking the lowest average temperature a measured in Step 3 as a standard, wherein when an average temperature of the ore body particles measured by the infrared thermal imager I is less than a, the ore body particles are the waste rocks, the waste rocks slip to the conveyor V at an output end of the conveyor II, and are conveyed to the goaf through the conveyor V; and when the average temperature of the ore body particles measured by the infrared thermal imager I is greater than a, the ore body particles are the ores, a controller opens air nozzles after t seconds according to a feedback of the infrared thermal imager I, at this time, the ores are just directly below the air nozzles, and the ores are blown to the conveyor III through the air nozzles;

Step 5: performing a next-stage treatment on the ores with a difference between a melting point of metal minerals and a melting point of gangue minerals exceeding 500° C., determining a best particle size of the ores for microwave heating through a dielectric property test, then outputting separated particles of the ores to the crusher through the conveyor III, and then performing crushing to the best particle size by the crusher;

Step 6: uniformly mixing the particles of the ores having the best particle size after being crushed by the crusher with graphite powder, and delivering the uniformly-mixed particles of the ores to the high-power microwave focused melting system, wherein according to the characteristics that the metal minerals absorb microwaves and have a melting point being smaller than that of the gangue minerals, the metal minerals in the ores are molten to flow out, when the infrared thermal imager II detects that a maximum temperature in the single-mode heating cavity reaches the melting point of the metal minerals, the conveyor IV starts to work, molten metal flows to the molten metal mineral pool through the mesh of the conveyor belt of the conveyor IV, and the separated gangue minerals are conveyed to the goaf through the conveyor V; and Step 7, performing parameter optimization: analyzing a composition of the gangue minerals, wherein a proportion of the graphite powder depends on a melting effect of the gangue minerals, when a content of the metal minerals in the gangue minerals is greater than or equal to 10%, a content of the graphite powder is increased, and a flow speed of the ores is reduced, and when the content of the metal minerals in the gangue minerals is less than 10%, the content of the graphite powder and the flow speed of the ores at this moment are used for working.

* * * * *